United States Patent [19]

Klostermann

[11] Patent Number: 4,545,064

[45] Date of Patent: Oct. 1, 1985

[54] X-RAY TUBE ROTOR MOUNTING

[75] Inventor: Heinrich F. Klostermann, Trumbull, Conn.

[73] Assignee: Litton Systems, Inc., Beverly Hills, Calif.

[21] Appl. No.: 546,616

[22] Filed: Oct. 28, 1983

[51] Int. Cl.[4] ..... H01J 35/04

[52] U.S. Cl. ..... 378/132; 378/121; 378/125; 313/237

[58] Field of Search ..... 378/131–133, 378/125, 126, 135, 137, 143–145, 305; 384/236; 313/146, 237, 255, 288

[56] References Cited

U.S. PATENT DOCUMENTS

| | | | |
|---|---|---|---|
| 2,216,888 | 10/1940 | Machlett | 378/132 |
| 2,230,857 | 2/1941 | Atlee | 378/132 |
| 4,024,424 | 5/1977 | Eggelsmann et al. | 378/132 |
| 4,316,129 | 2/1982 | Shapiro et al. | 378/45 |
| 4,326,144 | 4/1982 | Appelt | 378/132 |
| 4,413,356 | 10/1983 | Hartl | 378/132 |

*Primary Examiner*—Craig E. Church
*Assistant Examiner*—Charles F. Wieland
*Attorney, Agent, or Firm*—John M. Haurykiewicz; Walter R. Thiel

[57] ABSTRACT

A mounting system for securing a rotating anode of an x-ray tube against axial movement locates a bearing on a stud projecting from a tube end wall and secures the bearing on the stud by means of a threaded fastener which is accessed through a central bore of the rotating anode assembly prior to closure of the tube vacuum envelope.

11 Claims, 2 Drawing Figures

X-RAY TUBE ROTOR MOUNTING

FIELD OF THE INVENTION

This invention relates to a unique mounting for rotating anode assemblies in x-ray tubes. More particularly, this invention relates to a rotating anode x-ray tube wherein the anode shaft assembly is supported by a ball bearing at each end of the supporting shaft.

BACKGROUND OF THE INVENTION

It is important in rotating anode type x-ray tubes to positively locate the anode target axially to obtain the necessary focal spot stability.

Conventional mounting techniques for securing the anode against axial movement while allowing rotational freedom have proven to be difficult or impossible to apply to modern tube constructions.

One prior art technique of securing anode assemblies against axial movement provides radially disposed set screws as disclosed in U.S. Pat. No. 4,316,129.

The prior art also teaches peening a bearing housing to secure the bearing in its respective associated parts, as is taught in U.S. Pat. No. 4,326,144.

Such methods and mounting structures are inapplicable to the anode mounting structure disclosed herein due to the relative inaccessibility of the area used to secure the rotor assembly.

SUMMARY OF THE INVENTION

The present invention discloses a mounting for rotating anodes in an x-ray tube where the anode is mounted on a hollow assembly including a motor rotor and is supported by two bearings with one bearing secured against axial movement by a threaded fastener engaging a threaded stud projecting from an end wall of the x-ray tube envelope.

DETAILED DESCRIPTION

Figure 1:
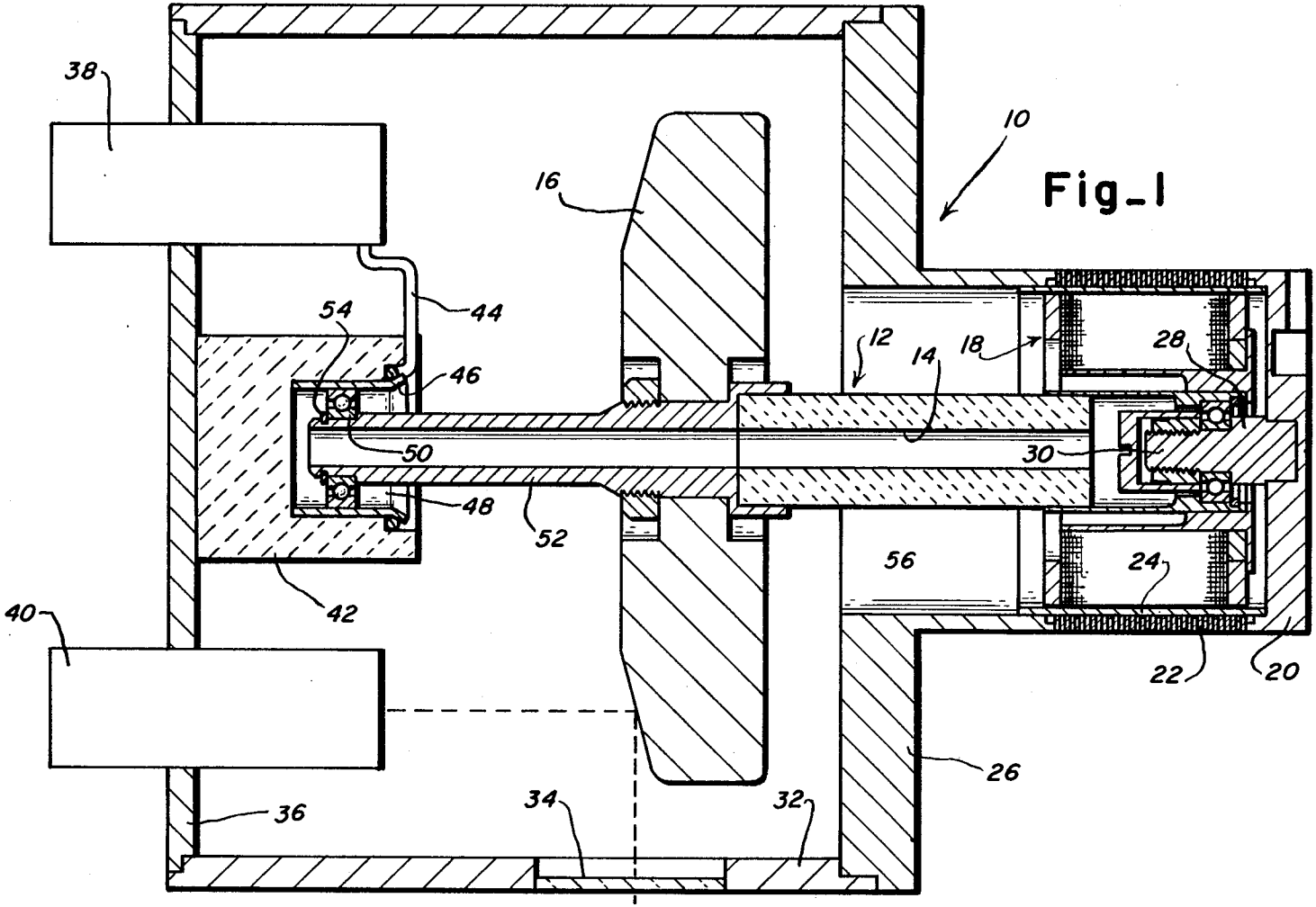
FIG. 1 is a section view of the x-ray tube showing the environment of the present invention.

Referring to FIG. 1, an evacuated or vacuum-tight x-ray tube envelope 10 carries a rotating anode assembly 12 having a central bore 14. Anode 16 is carried at a point on the assembly intermediate its ends. A motor rotor 18 is carried at one end of the assembly 12. Envelope 10 is made up (in part) of an end wall 20, a set of wall laminations 22, a sleeve 24, and a rotor end plate 26. A stud or cylindrical projection 28 is secured to end wall 20. Distal end 30 of stud 28 is threaded.

The rotor end of tube envelope 10 is preferably formed by positioning laminations 22 on sleeve 24 and brazing an end wall 20, preferably of 304L non-magnetic stainless steel, to laminations 22 and stud 28 to retain stud 28. This results in a relatively inaccessible bearing mounting location on stud 28. The rotor mounting of this invention overcomes this relative inaccessibility, however, as will be later described.

The tube envelope 10 is further made up of a cylindrical wall 32 carrying a conventional x-ray transparent window 34. The vacuum integrity of the tube envelope is completed by an anode end plate 36 through which an anode connector 38 and a cathode connector 40 project. An anode insulator 42 is mounted on end plate 36 and also forms a bearing mounting. Electrical connection to the anode is made by means of wire connector 44 which is trapped below a lip 46 of a metallic spring cup 48 which permits current to flow through a bearing 50 and a shaft 52 to anode 16. Bearing 50 is retained by a snap ring 54 on the end of shaft 52. Anode 16 is electrically isolated from rotor 18 by ceramic spacer 56.

Figure 2:
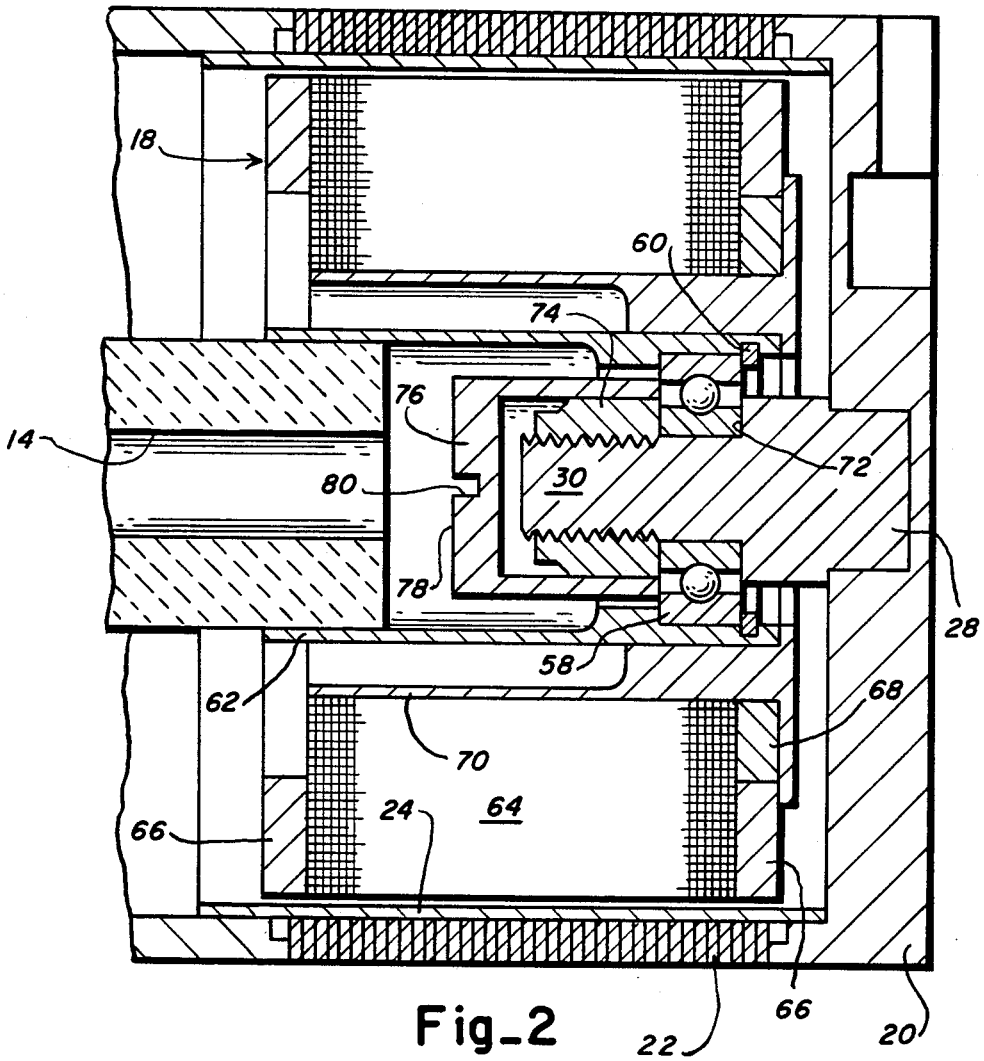
FIG. 2 is an enlarged view of the rotor end of the tube of FIG. 1 showing details of the present invention.

Referring now more particularly to FIG. 2, the rotor end of tube assembly 10 and rotor 18 may be seen in more detail. A bearing 58 is retained in rotor 18 by snap ring 60. Bearing 58 and snap ring 60 are carried by a sleeve 62, which is preferably formed of Kovar to enable its attachment to a ceramic spacer 56 by brazing. A set of rotor laminations 64 form a squirrel cage construction with a pair of end rings 66 and a rotor balancing weight 68. The rotor laminations 64, end rings 66, and balancing weight 68 are carried by a rotor sleeve insert 70 which is secured to sleeve 62. Bearing 58 is axially positioned by a shoulder 72 on stud 28. A nut 74 holds bearing 58 against shoulder 72. Nut 74 carries a slotted cap or head 76 which is secured thereto. Alternatively, an equivalent part may be formed corresponding to nut 74 and cap 76 which has internal threads to engage threaded distal end 30 of stud 28 and further has an appropriate configuration on end 78 to receive torque delivered by a tool (such as screw or nut driver) through bore 14.

To assemble this bearing mounting, nut 74 is loosely inserted into the rotor end of assembly 12. Bearing 58 and snap ring 60 are then installed, loosely retaining nut 74. Assembly 12 is then loaded into tube envelope 10 which may be complete except for end plate 36 and its respectively attached parts. A screw driver (or other appropriate tool) is inserted through central bore 14 to engage slot 80 in cap 76. As has been mentioned, any appropriate configuration between a driving tool and cap 76 may be provided at end 78 to permit torque transmission from the tool to cap 76. Cap 76 is then threaded onto and secured to stud 28. Finally, end wall 36 with its associated parts is then joined with the remainder of envelope 10 in a vacuum-tight relationship, as, for example, by Heliarc welding. Insulator 42 engages bearing 50 providing a bearing mounting which prevents radial movement, but allows axial movement of bearing 50 to accommodate thermal expansion of assembly 12 which occurs during normal tube operation.

The invention is not to be taken as limited to all of the details thereof as modifications and variations thereof may be made without departing from the spirit or scope of the invention. Accordingly, what is claimed is:

1. A rotating anode mounting for x-ray tubes comprising:

(a) a double-ended rotating assembly having a central bore open from end to end of said assembly and carrying:
  (i) an x-ray target anode,
  (ii) a motor rotor disposed at one end thereof and supported by a first bearing, and
  (iii) a second bearing disposed at the other end thereof;

(b) an x-ray tube envelope having a stud coaxial with said central bore; and (c) fastening means accessible through said central bore to secure one of said bearings to said stud to prevent axial motion therebetween.

2. The mounting of claim 1 wherein said fastening means secures said first bearing to said stud.

3. The mounting of claim 1 further comprising means to secure said first bearing to said rotating assembly to prevent axial motion therebetween.

4. The mounting of claim 3 further comprising means to secure said second bearing to said rotating assembly to prevent axial motion therebetween.

5. The mounting of claim 4 further comprising a bearing mounting member mounted on said envelope and having a bore to slideably receive said second bearing to permit axial motion of said second bearing in said bore.

6. The mounting of claim 5 wherein said bearing mounting member comprises an insulator.

7. In an x-ray tube of the type having a bearing-mounted rotating anode assembly contained within a vacuum-tight envelope, the improvement comprising:

(a) a hollow-central bore projecting entirely through said anode assembly, (b) rotatable fastening means axially driving against one end of an anode supporting bearing and adapted to be rotated by a tool projecting through said central bore of said rotating anode assembly; and (c) a cylindrical projection coaxial with said central bore, secured to said envelope, having a shoulder to receive and positively locate the other end of said bearing, and adapted to receive said fastening means to secure said anode assembly from further axial motion relative to said envelope.

8. The improvement of claim 7 wherein said rotatable fastening means and said projection are threaded together.

9. In a rotating anode x-ray tube, the improvement comprising:

(a) a rotating anode and rotor assembly having a central bore therethrough and supported for rotation by a pair of ball bearings;

(b) a vacuum-tight tube envelope having a threaded stud with a shoulder projecting inwardly from an end wall of said envelope coaxially with said central bore;

(c) a threaded nut captured within said rotating assembly and positioned to drive one of said bearings onto said stud by a tool projecting through said central bore;

such that said anode is positively positioned axially with respect to said envelope by locating said driven bearing.

10. The improvement of claim 9 wherein said nut has a slotted head to receive torque.

11. The improvement of claim 9 further comprising a bearing mounting secured to said tube envelope and adapted to allow axial movement the other of said bearings.

* * * * *